United States Patent [19]

Yamasaki

[11] Patent Number: 4,785,798

[45] Date of Patent: Nov. 22, 1988

[54] COMPACT MASSAGING APPARATUS FOR A SEAT HAVING FOLDABLE, HINGED HOUSING

[75] Inventor: Yoshikiyo Yamasaki, Osaka, Japan

[73] Assignee: Kabushiki Kaisha Fuji Iryoki, Osaka, Japan

[21] Appl. No.: 21,117

[22] Filed: Mar. 3, 1987

[51] Int. Cl.[4] ..... A61H 7/00

[52] U.S. Cl. ..... 128/46; 128/59

[58] Field of Search ..... 128/46, 59, 60, 61, 128/45

[56] References Cited

U.S. PATENT DOCUMENTS

| | | | |
|---|---|---|---|
| 912,016 | 2/1909 | Miller | 128/45 |
| 1,377,140 | 5/1921 | North | 128/59 |
| 1,913,462 | 6/1933 | Timar | 128/60 |
| 1,931,849 | 10/1933 | Matson | 128/45 |
| 2,206,902 | 7/1940 | Kost | 128/46 |
| 2,232,493 | 2/1941 | Stackey et al. | 128/67 |
| 2,806,470 | 9/1957 | Ferrier | 128/60 |
| 2,914,065 | 11/1959 | Cory | 128/45 |
| 3,001,523 | 9/1961 | Sugimoto | 128/59 |
| 3,322,117 | 5/1967 | McCaw | 128/46 |
| 3,374,784 | 3/1968 | Brent et al. | 128/61 |
| 3,625,204 | 12/1971 | Sekiguchi | 128/60 |
| 3,993,052 | 11/1976 | Miyahara | 128/46 |
| 4,016,872 | 4/1977 | Yamamara et al. | 128/46 |
| 4,282,768 | 8/1981 | Osborn | 74/473 R |
| 4,454,867 | 6/1984 | Swanson | 128/45 |
| 4,505,267 | 3/1985 | Inada | 128/59 |

FOREIGN PATENT DOCUMENTS

| | | | |
|---|---|---|---|
| 60-75060 | 4/1985 | Japan | 128/46 |

*Primary Examiner*—Charles Pearson
*Assistant Examiner*—Tonya Lamb
*Attorney, Agent, or Firm*—Flynn, Thiel Boutell & Tanis

[57] ABSTRACT

A compact massaging apparatus for a seat comprising a massaging unit contained within a containing part and a lower lid which can be closed and opened through an angle of 180°. The massaging unit is equipped with a box which contains a pair of worm wheels installed at both sides of a worm which engages them so that they may freely rotate. Vibration isolating plates with annular elastic rising part which applies a desired pressure to the inner wall of the box are installed on one or both of the upper surface and the lower surface of the worm wheels, and massaging balls connected to the top of the shaft of the worm wheels at a desired angle to circle relatively. The vibration isolating plates prevent vibration caused by the circling movement of the massaging balls, resonance noise from the containing part, and noise from the wheels to provide an even more comfortable massaging than conventional compact massaging apparatuses. Besides being used as a compact massaging apparatus, this apparatus can be used as a massaging apparatus for a seat by hanging it on the back of a seat such as a car seat or an office chair. Furthermore, opening and closed the lower lid enables this massager to massage any part of the back of a body.

5 Claims, 2 Drawing Sheets

COMPACT MASSAGING APPARATUS FOR A SEAT HAVING FOLDABLE, HINGED HOUSING

This application is related to my copending U.S. Ser. No. 068,465.

BACKGROUND OF THE INVENTION

1. Field of the Invention

This invention relates to a compact massaging apparatus for a seat which has a pair of massaging balls which relatively circle and can be used on a car seat, an office chair, or the equivalent.

2. Description of Prior Art

It is well known to provide vibrator type or massaging type portable or compact massaging apparatuses. Recently, massaging apparatuses with a pair of massaging balls which tremble or move relatively in opposite directions have become popular because of their soft feel in massaging.

A known massaging apparatus comprises, as shown in FIG. 1, a pair of worm gears 3 installed at both sides of a worm 2 within box 1, rounded ball-like massaging elements 5 installed on the top of shaft 4 of said worm gears 3 at a certain angle, and a motor M which rotates said worm 2 to relatively circle said massaging balls 5.

However, compact massaging apparatuses of this type have troubles such as the uneven sizes of said box 1 or noise or vibration between the worm 1 and the worm gears 3. Therefore, installing a massaging apparatus of this type on a car seat affects driving and installing it on an office chair decreases the concentration of a user because of the noise or vibration and annoys those who are near the user.

SUMMARY OF THE INVENTION

It is an object of the invention to provide a compact massaging apparatus for a seat which causes no noise and vibration, gives a comfort massage and can be easily positioned on a seat.

The compact massaging appararus includes a massaging unit having a pair of worm gears installed at both sides of a worm to engage the worm, a box to support and contain said worm gears so that they may freely rotate, a vibration isolating plate with an annular elastic rising part installed on one or both of the upper and lower surfaces of said worm gears which applies a desired pressure to the inner wall of said box, and massaging balls installed at the tops of shafts of said worm gears at a certain angle so that said massaging balls may circle relatively. Said massaging unit is put in a case having a concave surface to contain said massaging unit, holes are disposed above said concave surface to install said massaging balls, a sufficiently soft massaging ball protection cover covers said case, and handling parts are provided on both sides thereof. One of the sides of said concave surface of said containing part is connected with hinges to one of the sides of a lower lid to close and open through an angle of 180°. Said lower lid includes handling parts opposite said handling parts of said containing part.

PREFERRED EMBODIMENT OF THE INVENTION

Figure 1:
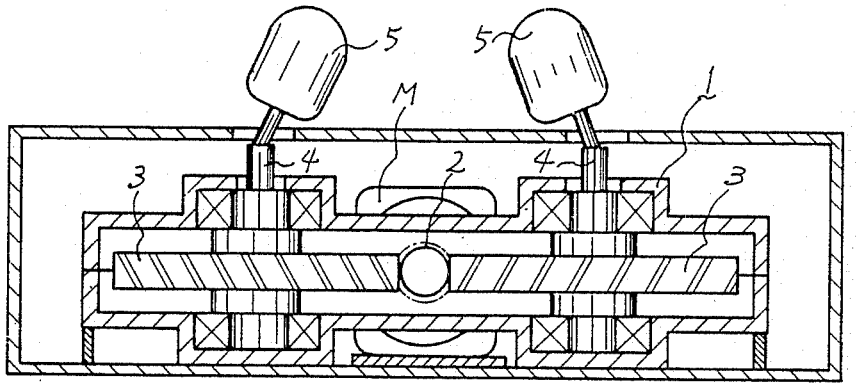
FIG. 1 PRIOR ART
FIG. 1 shows a compact massaging apparatus according to prior art.

In the figures, 11 is compact massaging apparatus for a seat according to the invention, 12 is worm rotated by motor M, and 13 are worm gears installed at both sides of said worm 12 and which engage with said worm 12 and simultaneously rotate in opposite directions.

14 is a massaging unit with said worm 12 and said worm gears 13 are contained in a box within which two pairs of bearings 15 to support shafts 16 are installed around said shafts 16 so they they may freely rotate and which are fixed on both the upper inner surface and the lower inner surface thereof.

17 is a vibration isolating rubber to prevent wobble of said shaft 16 supported by said bearings 15. Said vibration isolating rubber 17 is not always necessary. Said vibration isolating rubber 17 can be used, for example, when a box made of resin expands or contracts in size which may cause wobble.

19 are rounded ball-like massaging elements connected to the top of said shafts 16 by dish-shape connecting parts 18. Said massaging balls 19 are installed at a certain angle to said shafts 16 so that they relatively circle.

Figure 2:
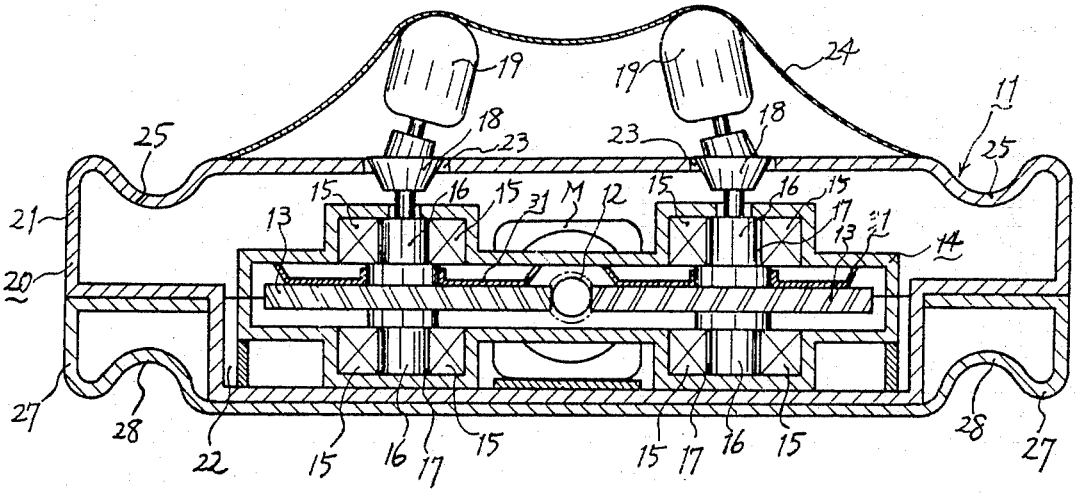
FIG. 2 is a vertical sectional view of a preferred embodiment of this invention.
Figure 3:
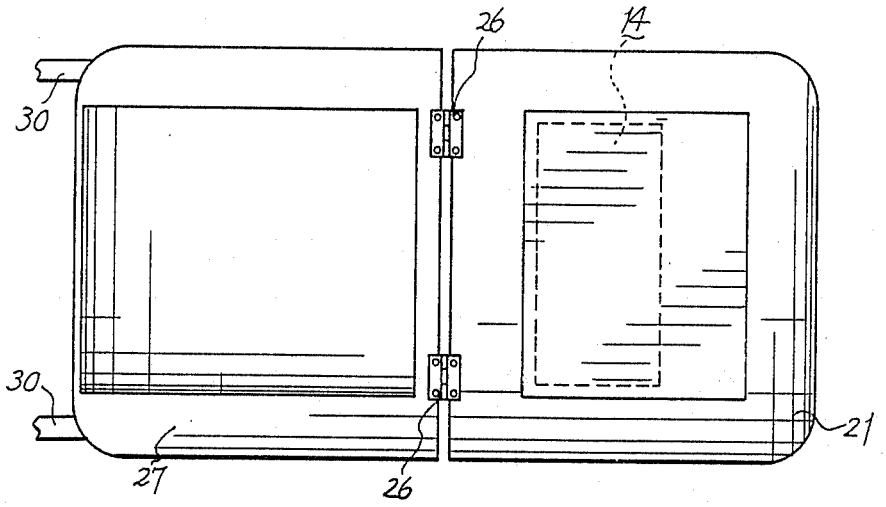
FIG. 3 is a plan view showing the inside of the case in an opened position.
Figure 4:
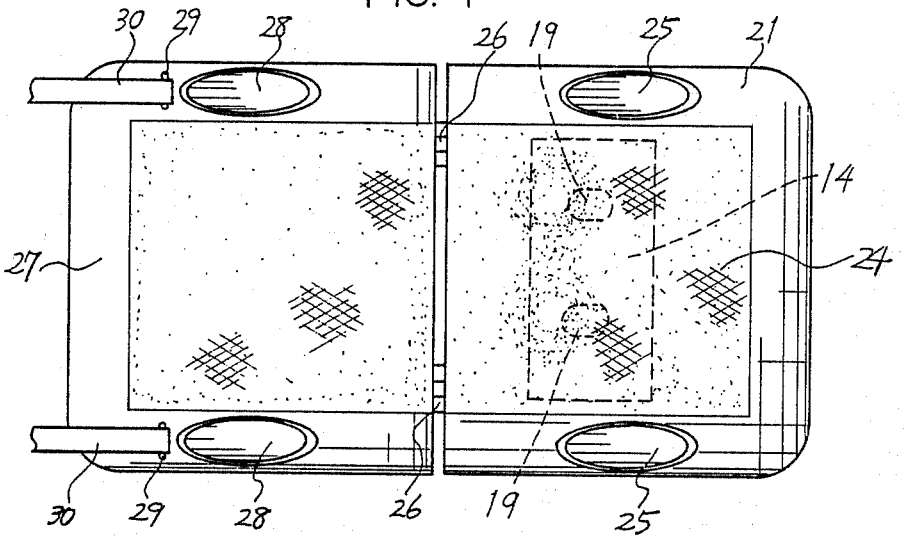
FIG. 4 is a plan view like FIG. 3 but showing the outside of the case.

20 is a case for the massaging apparatus and contain said said massaging unit 14. As shown in FIGS. 2, 3, and 4, said case for the massaging apparatus 10 comprises a containing part 21 and a lower lid 27. Said containing part 21 comprises a concave surface 22 to hold said massaging unit 14, holes 23 to install said massaging balls 19 above said concave part 22, a sufficiently soft masssaging ball protection cover 24 which covers the upper part of said containing part 21, and handling parts 25 on both sides of said containing part 21. One of the sides of said lower lid 27 is connected with one of the sides of said concave surface 22 of said containing part 21 with hinges 26 to close and open through an angle of 180°. Said lower lid 27 includes handling parts 28 opposed to said handling parts 25 of said containing part 21.

Metal fixtures 29 for a belt 30, shaped like a rectangle without one of the sides, are installed at the opposite sides of said lower lid 27 of said case for massaging apparatus 20 to install belt 30 to hang said apparatus on the back of a car seat, an office chair, or the equivalent.

Figure 5:
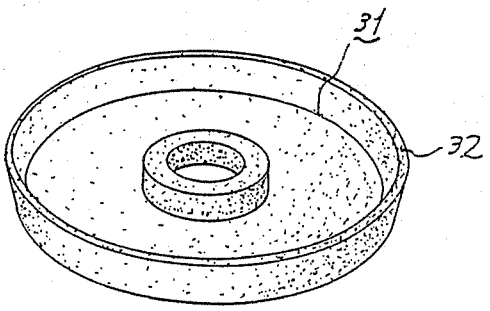
FIG. 5 is a perspective view of a preferred embodiment of a vibration isolating plate used for this invention.

31 which is shown in FIGS. 2 and 5 is a ring-shaped vibration isolating plate fixed on one or both of the upper surface and the lower surface of said worm gears 13. Said vibration isolating plate 31 has one or more annular elastic rising ring parts 32 which bears against to the inner wall of said box of said massaging unit 14 at a desired pressure. Said elastic rising part 32 absorbs noise which is caused by the rotation of said worm gears 13 and vibration which said massaging unit 14 conducts to said box.

In operation, driving motor M rotates said worm 12, and then said pair of worm gears 13 installed at both sides and engaged with said worm 12, rotate in opposite directions to relatively circle said massaging balls 19 connected to the top of said shafts 16 of said worm gears 13. Under the normal operating conditions, the back or the scruff of the neck of the body of a user is applied to said massaging balls 19 and can be comfortably massaged because the user feels no noise and vibration. When closed or opened through an angle of 180°, said lower lid 27 of said case for massaging apparatus 20 enables the apparatus to be located on a place such as the floor of a house with said massaging balls 19 extending upwardly. The back or the scruff of the neck of the body of a user applied to said massaging balls 19 at a proper height can be comfortably massaged because the user feels no noise and vibration. The apparatus hung with said belt 30 can be installed by passing a belt through said metal fixtures 29 and attaching it on the back of a car seat and can massage the part of the body of a user without affecting driving. The apparatus hung with said belt 30 can be installed by passing a belt 30 through said metal fixtures 29 and attaching it on the back of an office chair and can massage the part of the body of a user whenever the user wants without annoying those who are near the user. This is because the the apparatus is free from uncomfortable noise and vibration.

Although only one embodiment of the invention has been disclosed, it is apparent that this invention is not limited thereto or thereby.

What is claimed is:

1. A compact massaging apparatus, such as for a seat, comprising:

a substantially closed outer housing means including upper and lower housing sections which are hingedly connected together for relative hinging movement between a closed position wherein the upper and lower housing sections directly oppose and engage one another to define a substantially closed housing and an open position wherein the upper and lower housing sections are relatively hingedly moved away from the closed position through an angle of about 180°, said upper housing section including a concave part which projects therefrom into the lower housing section when the upper and lower housing sections are in said closed position, said upper housing section including an top wall section which is positioned above and overlies the concave part when in said closed position;

a massaging unit mounted in said concave part so as to be disposed substantially below said upper wall section when in said closed position;

said upper and lower housing sections cooperating to define handle parts disposed adjacent opposite sides of said housing means;

said massaging unit including an inner box-like housing which is positioned within said concave part below said top wall section, said inner housing having a worm rotatably supported therein and a pair of worm gears rotatably supported therein and disposed in meshing engagement with opposite sides of said worm so that the worm gears simultaneously rotate in opposite directions, a pair of support shafts rotatably supported in said inner housing and nonrotatably and coaxially coupled to said worm gears, and bearing means rotatably supporting said support shafts on said inner housing, each support shaft having a coaxial shaft part which projects upwardly through said inner housing and into an opening through said top wall section, and a motor drivingly coupled to said worm for effecting rotation thereof;

a pair of rounded ball-like massaging elements positioned outside said housing means adjacent said top wall section for simultaneous orbital rotation in opposite directions, each massaging element being nonrotatably coupled to a respective one of said shaft parts for rotation therewith and disposed in offset relation relative to rotational axis of the respective support shaft so as to undergo an orbiting circular rotation;

a flexible sheet-like cover of a soft material attached to said upper housing section and disposed so as to extend over and enclose said massaging elements; and belt-receiving fixtures mounted on said housing means adjacent opposite sides thereof and adapted to receive belts to permit hanging of the massaging apparatus on a seat back.

2. The apparatus of claim 1, wherein the massaging elements are connected to the shaft parts by dish-shaped connecting parts which are positioned within openings formed in the top wall section.

3. The apparatus of claim 1, wherein vibration-isolating rubber members are interposed between said bearing means and said support shafts.

4. The apparatus of claim 1, wherein vibration-isolating rings are mounted on at least one side face of each worm gear and are disposed in resilient bearing engagement with a wall of said inner housing.

5. The apparatus of claim 1, wherein the upper and lower housing sections are hingedly joined together adjacent one end of said housing means, and wherein said belt-receiving fixtures are provided on said housing means adjacent an end thereof which is opposite from the hinged end.

* * * * *